US006751890B1

(12) United States Patent
Tsai

(10) Patent No.: US 6,751,890 B1
(45) Date of Patent: Jun. 22, 2004

(54) STRUCTURE OF VENTILATED SHOE BOTTOM

(76) Inventor: Mao-Cheng Tsai, No. 22, Lane 42, Dafeng Rd., Shengang Shiang,Taichung (TW)

( * ) Notice: Subject to any disclaimer, the term of this patent is extended or adjusted under 35 U.S.C. 154(b) by 0 days.

(21) Appl. No.: 10/348,172

(22) Filed: Jan. 22, 2003

(51) Int. Cl.[7] ..... A43B 7/08
(52) U.S. Cl. ..... 36/3 B; 36/29
(58) Field of Search ..... 36/3 B, 3 R, 147, 36/29, 28

(56) References Cited

U.S. PATENT DOCUMENTS 1,852,883 A * 4/1932 Gustaveson ..... 36/3 R
4,187,620 A * 2/1980 Selner ..... 36/28
4,547,978 A * 10/1985 Radford ..... 36/3 B
4,910,882 A * 3/1990 Goller ..... 36/3 B
5,619,809 A * 4/1997 Sessa ..... 36/3 R
5,915,819 A * 6/1999 Gooding ..... 36/29
5,992,052 A * 11/1999 Moretti ..... 36/3 B

* cited by examiner

*Primary Examiner*—Ted Kavanaugh
(74) *Attorney, Agent, or Firm*—Birch, Stewart, Kolasch & Birch, LLP

(57) ABSTRACT

The invention provides a structure of ventilated shoe bottom, which includes an outsole of a shoe and a cushion provided on top of the outsole to be engaged with the outsole. A concave portion that allows the cushion to be placed in is provided at the upper side of the outsole, and the surface of the concave portion is designed to be a waveform surface according to the arch of a human foot. Pluralities of calabash-shape holes are provided inside the outsole, directly reaching to the surface of the outsole. Inside the cushion, pluralities of vents are provided corresponding to each of the holes. The top openings of the vents are smaller than the bodies of the vents so as to be used like air bags, which can inflate and deflate easily to achieve the effect of ventilation.

2 Claims, 5 Drawing Sheets

STRUCTURE OF VENTILATED SHOE BOTTOM

FIELD OF THE INVENTION

The invention relates to a structure of shoe bottom of a sports shoe and, more particularly, to pluralities of arch-shape holes and vents that are correspondingly distributed on the outsole and insole of a shoe to provide an elastic air cushion effect capable of pumping out air when a person's walking foot is pressing down, and taking in air when the walking foot is lifting to obtain an effect of ventilation.

BACKGROUND OF THE INVENTION

Referring to FIGS. 1A and 1B, a conventional structure of air cushion shoe is mostly to supply different sizes of vents 3 and 4 on the outsole land the insole 2 in relative positions. The conventional structure is designed to pump out stagnant air staying between the insole 2 and the outsole 1 when a person's walking foot is pressing down on the insole 2, and to take in outside air when the walking foot is lifting and the compressing pressure from the foot is disappeared so that the insole and outsole can restore to their original shapes. Therefore, during the pressing down and lifting up interval, the air inside the vents 3 and 4 is pumping out and taking in to obtain an effect of ventilation. However, the vents 3 and 4 on the outsole 1 and insole 2 are holes with the same diameter. When the waking foot is pressing down on the insole 2, both outsole 1 and insole 2 will be flattened because of the pressure. However, because vents 3 and 4 have the same diameter, there is no space between them to accommodate bending and distortion. Therefore, the air that can be pumped out and taken in is very limited. As a result, the effect of ventilation and the function of air cushion that the outsole 1 and the insole 2 can provide become very limited as well.

SUMMARY OF THE INVENTION

The object of the invention is to provide a structure of ventilated shoe bottom, which is designed to have arch-shape holes and vents on the outsole and the insole so that there will be enough space to be compressed and distorted, the circulation of coming-in and going-out air will be good, and an air cushion effect capable of deflating and inflating is provided.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENTS

Figure 1A:
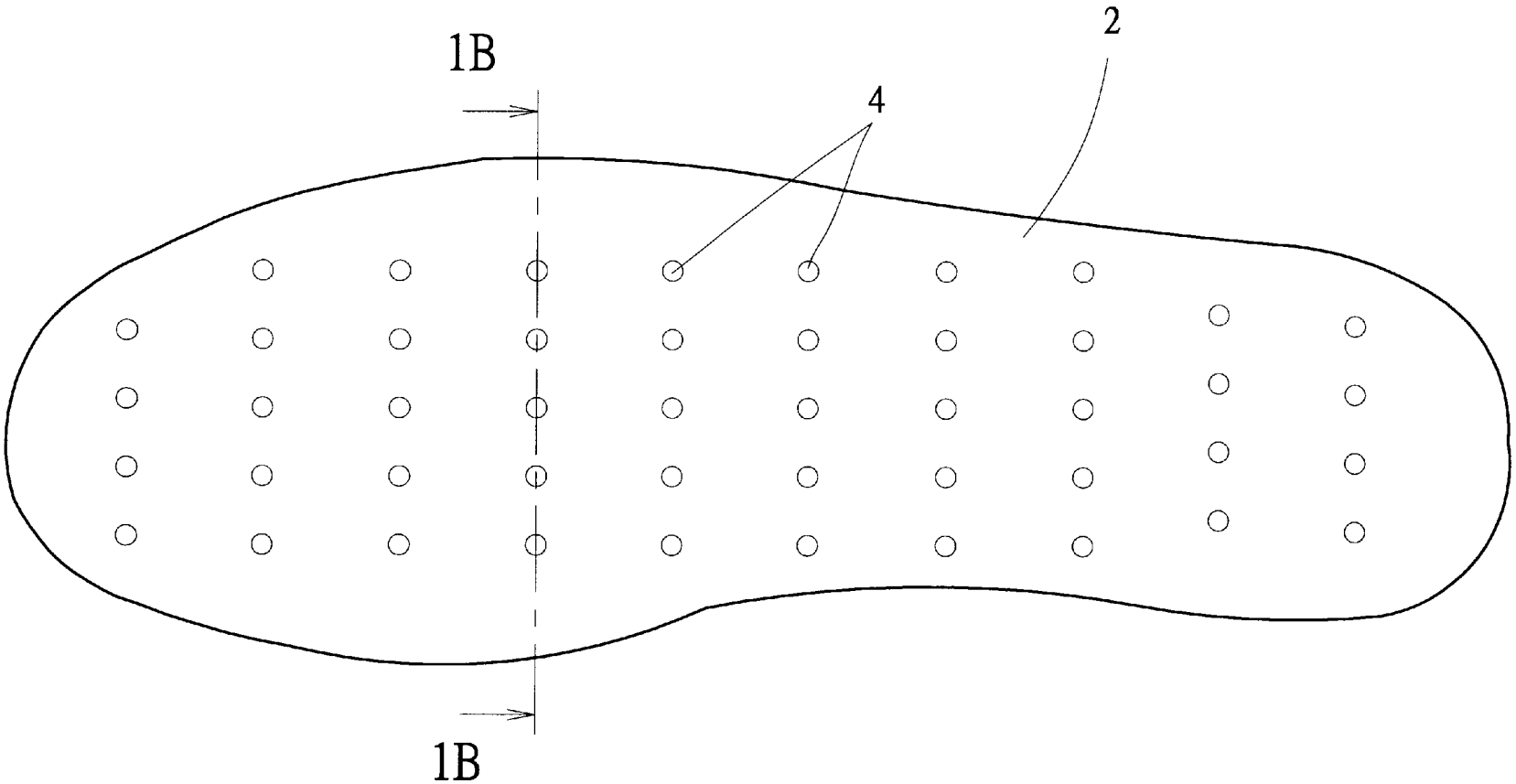
PRIOR ART FIG. 1A
FIG. 1A is a schematic plan view of a conventional air cushion shoe.
Figure 1B:
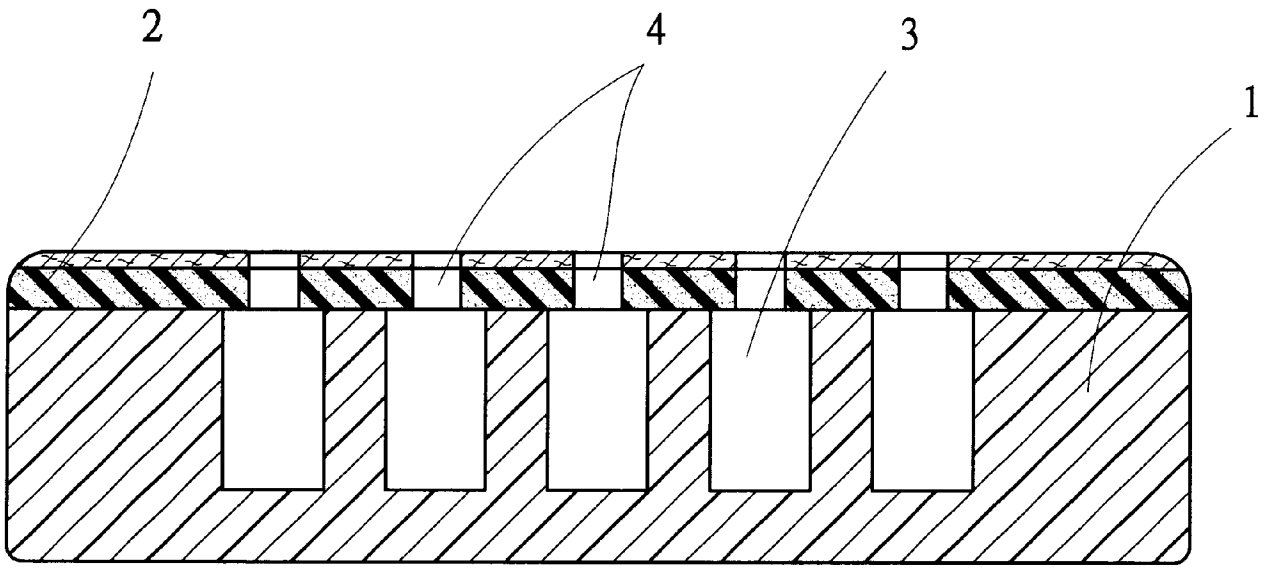
PRIOR ART FIG. 1B
FIG. 1B is a sectional view of 1B—1B shown in FIG. 1A.
Figure 2:
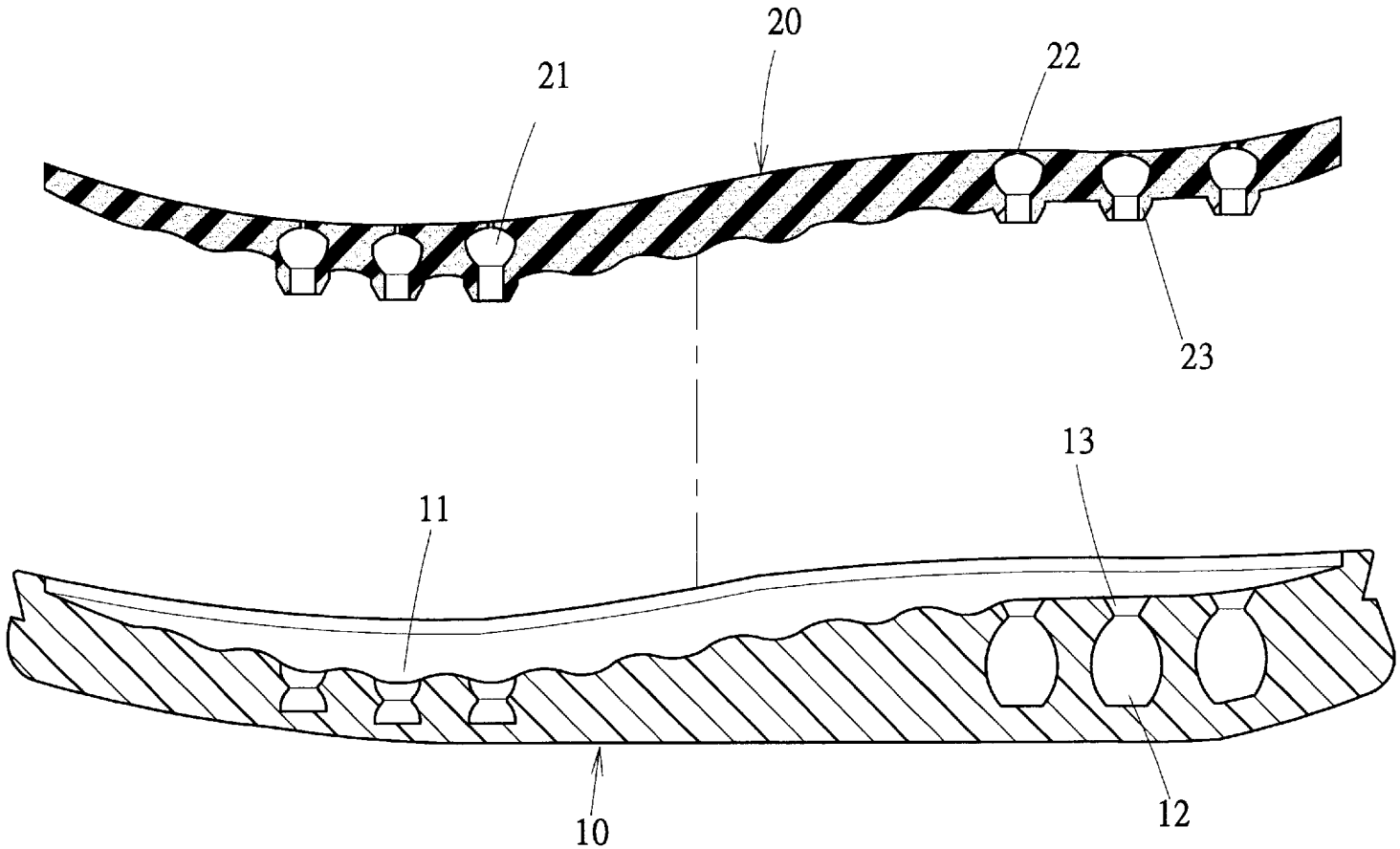
FIG. 2 is a schematic plan view of an embodiment of the invention.

Referring to FIG. 2, the structure of ventilated shoe bottom of the invention includes a shoe outsole 10 made of elastic rubber; a concave portion 11 designed according to the arch of a human foot is provided at the upper side of outsole 10, and a waveform surface is provided on the concave portion 11; and pluralities of holes 12 are distributed on the front bottom and rear bottom of the outsole 10 along the thickness of the concave portion 11, wherein the shape of inner walls of the holes 12 is like a calabash, and the holes 12 can directly reach the surface of concave portion 11; on the other hand, the shape of the top openings of the holes is like a wedge, whose upper portion is wider than the lower portion, and the top openings are shown as wedge-shape holes 13 in FIG. 2.

Also, a cushion 20 with appropriate thickness is provided, and its rim is designed in accordance with the contour of the outsole 10 accompanied by the concave 11. Pluralities of vents 21 are provided inside the cushion 20 penetrating through the surface of cushion 20, and the position of each vent is corresponding to one of the holes 12 located on the outsole 10. The inner wall of each of the vents 20 is designed as a protruded arch. The openings 22 of the vents 21 are smaller than the bodies of vents 21 and are distributed on the surface of the cushion 20. Moreover, pluralities of protrusions 23 are provided at the bottom of cushion 20, and each of them is designed in accordance with one of the wedge-shape holes 13 on the outsole 10 accompanied by the concave 11. Each of the vents 21 is extended to reach one of the protrusions 23 and then is narrowed down to form a square-shape hole. Besides, the vents 21 are smaller than the holes 12.

Figure 3:
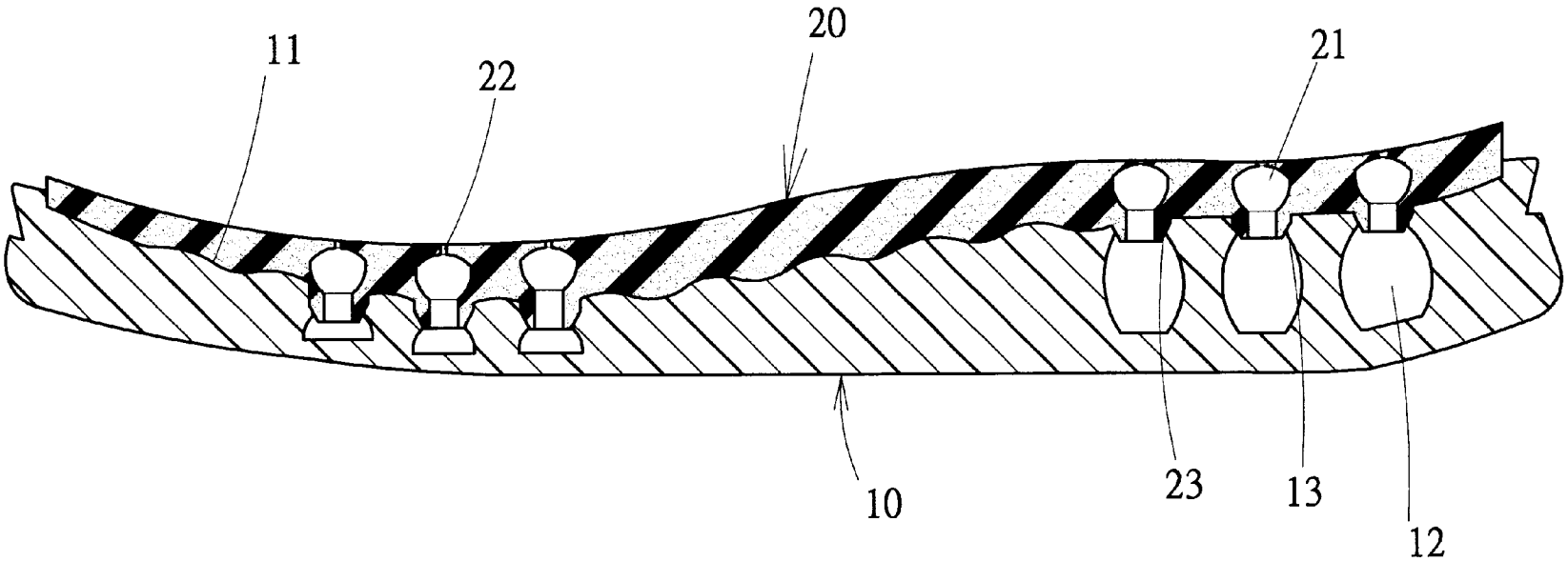
FIG. 3 is a sectional view showing the assembly of a shoe bottom of an embodiment of the invention.
Figure 4:
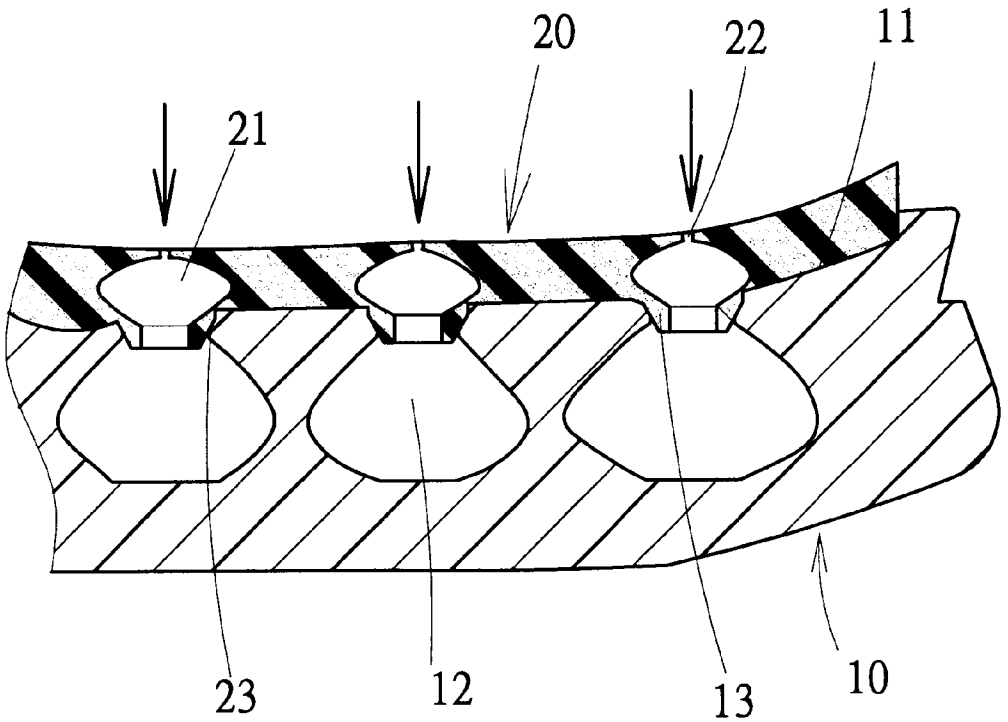
FIG. 4 is a partially schematic view of an embodiment of the invention.

Next, referring to FIGS. 3 and 4, to assemble the shoe bottom, the protrusions 23 distributed at the bottom of the cushion 20 will be engaged with the wedge-shape holes on the outsole 10. By doing so, the vents 21 can go directly through the holes 12 of the outsole 10, forming an air chamber ready for accommodating air. When a person's foot presses down the cushion 20, the cushion will be flattened due to receiving the person's weight. Correspondingly, the outsole 10 will be compressed as well, which in turn also makes the holes 12 flattened. Consequently, the air staying in the holes will be pumped out discharging through the vents 21, and the air will pass through the openings 22 of the cushion 20 to be discharged upwardly. On the other hand, when the person lifts his/her foot, the cushion 20 and the outsole 10 will lose the compressing force from the person at the same time. At this moment, the holes 12 of the outsole 10 and the vents of the cushion 20 will take in air from outside the shoe to restore their original shapes. Hence, by motions of pumping out and taking in, the stagnant air will be discharged and the air outside the shoe will be taken in so as to achieve the effect of ventilation.

In particular, the holes 12 inside the outsole 10 are chambers in the shape of a calabash. When the outsole 10 is pressed down, the holes 12 can be compressed and flattened easily as well as the air inside the holes can be squeezed out rapidly. Likewise, the vents 21 inside the cushion 20 have arch-shape inner walls. The vents 21 can also be easily flattened when they are compressed and will discharge the inside air rapidly. Above all, the openings 22 of the vents 21 are tiny outlets that are smaller than the bodies of the vents. The vents 21 perform very well in ventilation because they can work like air bags to squeeze out and take in air quickly. Moreover, the holes 12 of the outsole 10 and the vents 21 of the cushion 20 of the invention are larger than the conventional air holes with equal diameter. Therefore, the scale of inflation and deflation of the outsole 10 and cushion 20 of the invention can be larger as well, which means that they have good air cushion effect.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A structure of ventilated shoe bottom, includes an outsole of a shoe and a cushion that is on top of the outsole and to be engaged with the outsole, wherein a concave portion is provided on the upper side of the outsole, and the cushion can be placed therein; a predetermined number of holes having arch-shaped inner walls are distributed appropriately inside the outsole; a plurality of arch-shaped vents are provided inside the cushion, each vent having a top and a body, and each vent corresponding to one of the holes, whereas openings are provided at the top of the vents, the openings being smaller than the bodies of the vents, wherein the holes of the outsole are composed of inner walls having a top opening, wherein the top openings of the holes are wedge-shaped holes, wherein the upper portion of each hole is wider than its lower portion; a protrusion is provided corresponding to each of the wedge-shaped holes on a bottom of the cushion, and the vents can directly reach to the openings of the bottom of the protrusions when the vents are compressed.

2. The structure of ventilated shoe bottom as claimed in claim 1, wherein a surface of the concave portion on the outside is a waveform surface, and the bottom of the cushion is provided in accordance with the waveform surface of the outsole.

* * * * *